US005601032A

United States Patent [19]

Kosch

[11] Patent Number: 5,601,032

[45] Date of Patent: Feb. 11, 1997

[54] APPARATUS FOR OPENING AND CLOSING RAILROAD HOPPER CAR DISCHARGE DOORS

[75] Inventor: Alois J. Kosch, Columbus, Nebr.

[73] Assignee: Industrial Engineering Co., Columbus, Nebr.

[21] Appl. No.: 596,070

[22] Filed: Feb. 6, 1996

[51] Int. Cl.[6] ..... B61D 7/26

[52] U.S. Cl. ..... 105/304; 105/308.2; 105/310

[58] Field of Search ..... 105/296, 299, 105/304, 308.1, 308.2, 310

[56] References Cited

U.S. PATENT DOCUMENTS

| | | | |
|---|---|---|---|
| 3,450,065 | 6/1969 | Floehr et al. | 105/296 |
| 3,455,253 | 7/1969 | Floehr | 105/296 |
| 3,654,873 | 4/1972 | Floehr | 105/296 |
| 4,163,424 | 8/1979 | Lindauer | 105/296 |
| 4,601,244 | 7/1986 | Fischer | 105/299 |
| 5,261,333 | 11/1993 | Miller | 105/308.1 |

*Primary Examiner*—S. Joseph Morano
*Attorney, Agent, or Firm*—Zarley, McKee, Thomte, Voorhees & Sease; Dennis L. Thomte

[57] ABSTRACT

An apparatus for opening and closing the discharge doors of a railroad hopper car is described comprising a mounting frame secured to the hopper car forwardly of the discharge door and having a pivot frame pivotally secured thereto which is interconnected to the discharge door by an elongated linkage. A pivot arm is also pivotally secured to the mounting frame and has an air cylinder pivotally secured thereto which is interconnected to the pivot frame. Extension of the hydraulic cylinder causes the pivot frame to pivot with respect to the mounting frame thereby causing the adjustable linkage to open the door. Retraction of the cylinder rod into the cylinder causes the pivot frame to pivot with respect to the mounting frame to cause the adjustable linkage to close the discharge door. When the door is in its closed position, the cylinder rod of the air cylinder is in its retracted position. The alignment of the various components and pivot points ensures that the discharge door cannot come open during transportation should the air cylinder fail.

25 Claims, 5 Drawing Sheets

APPARATUS FOR OPENING AND CLOSING RAILROAD HOPPER CAR DISCHARGE DOORS

BACKGROUND OF THE INVENTION

1. Field of the Invention

This invention relates to an apparatus for opening and closing railroad hopper car discharge doors. More particularly, the invention relates to an air powered apparatus which may be installed on existing railroad hopper cars, without extensive modification thereof, to improve the operation of opening and closing the car discharge doors.

2. Description of the Related Art

Railroad hopper cars normally include a hopper body supported upon an undercarriage. The hopper body normally has a front wall, a back wall and opposite side walls which define an open upper end. In some cases, the open upper end is closed by compartment doors. Although the design of the bottoms of hopper cars varies considerably, the hopper body usually has a plurality of funnel-shaped hopper bottom portions, each of which has one or more discharge doors or covers selectively closing a discharge opening. The doors selectively close the discharge openings so that the material, such as coal or the like, contained in the hopper car may be discharged therethrough. Many prior art railroad hopper cars utilize various mechanical means for opening and closing the discharge doors but, to applicant's knowledge, those prior art devices are cumbersome to use and are not safe to use. Further, it is not believed that the locking means for ensuring that the discharge doors remain positively closed during transport are as fail-safe as they should be. For example, some of the prior art devices which include an air cylinder means for opening the discharge door or doors could possibly suffer inadvertent opening of the discharge doors if the air pressure in the air cylinders is lost. Further, those air powered systems of the prior art which are installed on the hopper cars during the initial manufacture thereof do not lend themselves to retrofitting existing hopper cars.

SUMMARY OF THE INVENTION

The apparatus of this invention is used in combination with a railroad hopper car including one or more generally funnel-shaped hopper bottoms having exterior and interior surfaces and opposite sides, as well as front and rear walls, which extend downwardly and inwardly towards one another. A plurality of horizontally spaced discharge openings are formed in the front or rear walls of each hopper bottom portion. A discharge door is pivotally secured to the exterior surface of the front or rear wall to selectively close each of the discharge openings. For purposes of description, it will be assumed that the discharge doors to be operated are located on the exterior surface of the front wall of a hopper bottom portion, although the discharge doors are also located on the rear walls of some of the hopper bottom portions. The apparatus of this invention comprises at least one mounting frame which is operatively secured to the hopper forwardly of and below the pivotal connection of the doors to the hopper. The mounting frame extends downwardly from the hopper and has a pivot frame pivotally secured thereto, about a horizontal axis, intermediate the upper and lower ends thereof. A linkage pivotally connects the rearward end of the pivot frame to at least one of the doors, and preferably a plurality of the doors, so that rearward movement of the linkage will pivotally move the discharge doors towards their closed position and so that forward movement of the linkage with respect to the hopper will pivotally move the doors towards their open position. A pivot arm assembly is pivotally secured to the mounting frame and has an elongated power cylinder, such as an air cylinder, pivotally connected to its forward end. The power cylinder extends rearwardly from the forward end of the pivot arm assembly and has its cylinder rod pivotally connected to the pivot frame. Extension of the cylinder rod from the power cylinder causes the pivot frame to pivot relative to the mounting frame, thereby causing the linkage to move the discharge doors to their open position. Retraction of the cylinder rod into the power cylinder causes the pivot frame to pivot relative to the mounting frame so that the linkage moves the discharge doors to their closed position. When the discharge doors are in their closed position, the cylinder rod is retracted so that the rod will not be subjected to dirt, dust, etc. When the cylinder rod is in its retracted position, the alignment of the cylinder center line, the longitudinal axis of the pivot frame and the longitudinal axis of the linkage is such that they are in substantial alignment so that when the air pressure is removed from the power cylinder, the doors will remain closed.

It is therefore a principal object of the invention to provide an improved apparatus for opening and closing the discharge doors of a railroad hopper car.

Still another object of the invention is to provide an apparatus of the type described above which utilizes an air cylinder.

Still another object of the invention is to provide an apparatus of the type described above which may be installed on existing hopper cars.

Still another object of the invention is to provide an apparatus of the type described above which is convenient and safe to use.

Still another object of the invention is to provide an apparatus of the type described above which ensures that the discharge doors will remain closed when the air cylinder is disconnected from its source of air pressure.

Still another object of the invention is to provide an apparatus of the type described above which includes an air cylinder having the cylinder rod in a retracted position during the normal transport use.

These and other objects will be apparent to those skilled in the art.

DESCRIPTION OF THE PREFERRED EMBODIMENT

Figure 1:
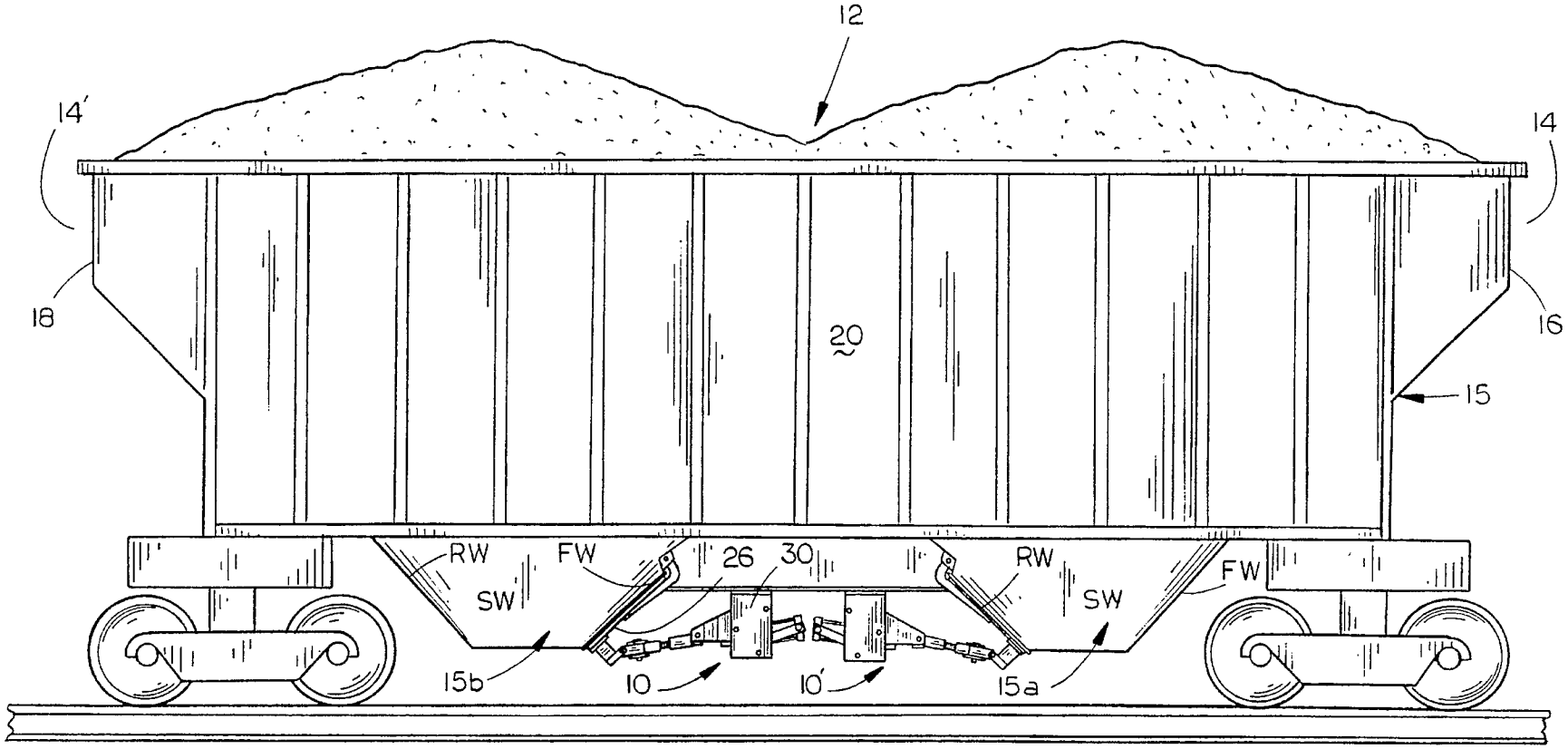
FIG. 1 is a side view of a railroad hopper car having two of the devices of this invention mounted thereon.

The apparatus of this invention for opening and closing the discharge doors of a railroad hopper car is referred to generally by the reference numeral 10 while the reference numeral 12 refers to the hopper car. For purposes of description, the railroad hopper car will be described as having a forward end 14 and a rear end 14', although hopper cars are obviously capable of being transported in either a forward or rearwardly direction so that the forward end of the car would become the rearward end and vice versa. Throughout the description of the invention and in the claims, the hopper car will be described as having rearward and forward ends, although those ends are obviously dependent upon which direction the car is to travel. Although hopper cars have a variety of configurations, they generally have a hopper body 15 defined by a front wall 16, rear wall 18 and opposite side walls 20. In most configurations, the hopper body has an open upper end, but the same could be closed, if so desired, with appropriate compartment doors being provided. The hopper body is provided with a plurality of funnel-shaped hopper bottom portions 15*a*, 15*b*, etc. In the drawings, only a pair of hopper bottoms 15*a* and 15*b* are illustrated, but it should be understood that any number of hopper bottom portions could be utilized. Assuming that the forward end of the hopper car is to the right, as viewed in FIG. 1, as previously described, hopper bottom portion 15*a* includes a front wall FW and a rear wall RW. Hopper bottom portion 15*a* also includes a pair of side walls SW, only one of which is shown in the drawings. Similarly, hopper bottom portion 15*b* includes a front wall FW, rear wall RW and side walls SW, only one of which is shown in the drawings. Rear wall RW of hopper bottom portion 15*a* and front wall FW of hopper bottom portion 15*b* are provided with one or more discharge openings 24 formed therein which are selectively closed by pivotal doors 26 as will be described in greater detail hereinafter.

The apparatus 10 of this invention is positioned between rear wall RW of hopper bottom portion 15*a* and front wall FW of hopper bottom portion 15*b* to selectively open and close the doors 26 on front wall FW of hopper bottom portion 15*b*. Another apparatus 10' would also be positioned between rear wall RW of hopper bottom portion 15*a* and front wall FW of hopper bottom portion 15*b* to selectively open and close the doors 26 on rear wall RW of hopper bottom portion 15*a*. As seen in the drawings, each of the doors 26 is pivotally connected at 28 to the exterior surface of the respective hopper bottom portion.

Figure 2:
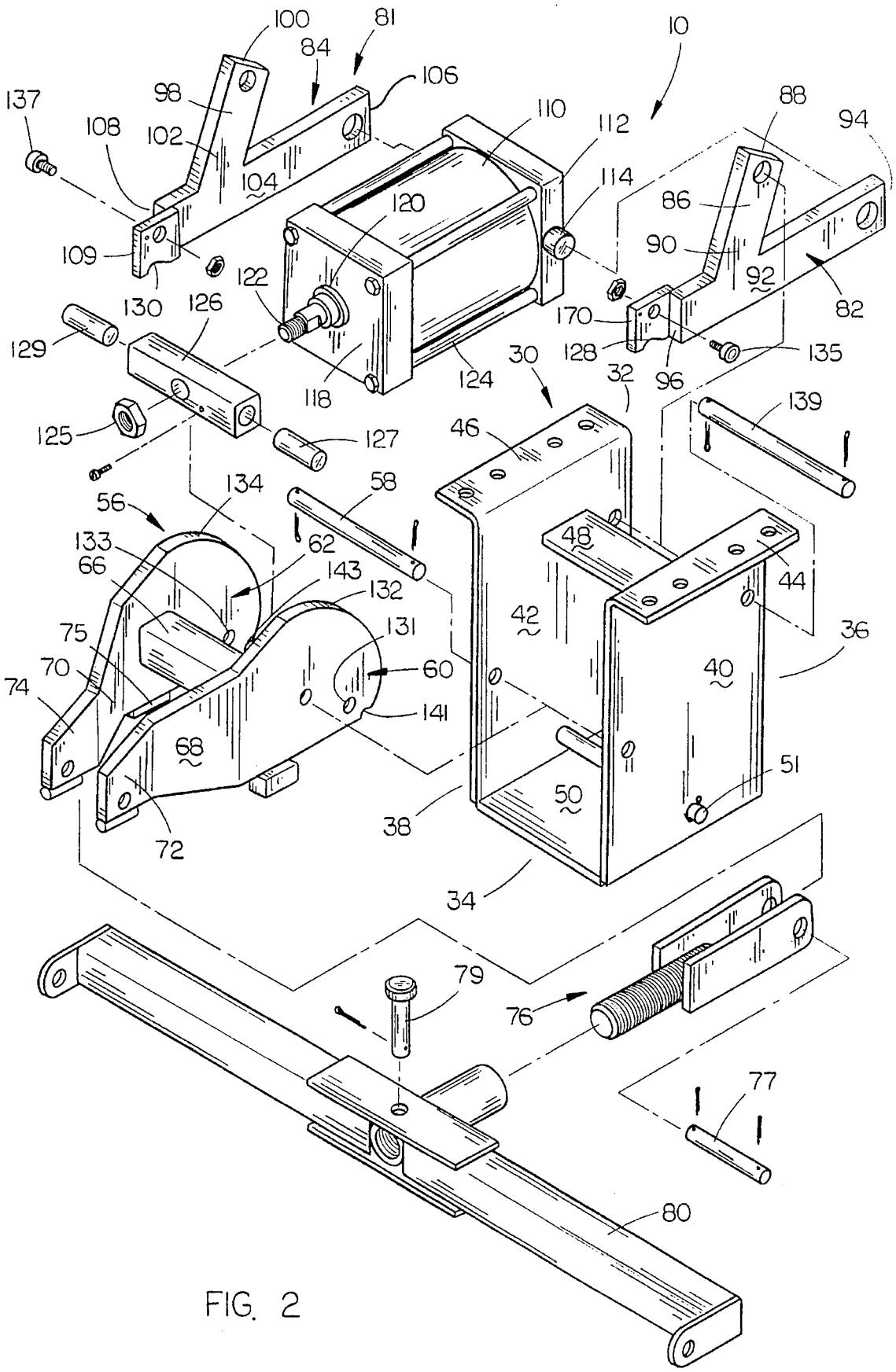
FIG. 2 is an exploded perspective view of the device of this invention.

The apparatus 10 of this invention includes a mounting frame 30 having an upper end 32, lower end 34, forward end 36 and rearward end 38 (FIG. 2). Mounting frame 30 includes a pair of horizontally spaced mounting frame members 40 and 42 having flanges 44 and 46 provided at their upper ends thereof which are secured by any convenient means such as bolts, welding, etc., to a suitable frame mounting structure, such as frame member FM, on the hopper. Preferably, brace 48 is secured to and extends between the mounting frame members 40 and 42 near the upper ends thereof. Also, a brace or support 50 is preferably secured to the lower ends of the mounting frame members 40 and 42 and extends therebetween, as seen in FIG. 2. Pin 51 extends between frame members 40 and 42, as also seen in FIG. 2.

The numeral 56 refers generally to a pivot frame which is pivotally secured to mounting frame 30 by means of pin or shaft 58. Pivot frame 56 includes a pair of pivot frame members 60 and 62 which are horizontally spaced-apart and which have a tube 66 secured thereto and extending therebetween. Pivot frame members 60 and 62 include rearwardly and inwardly extending wall portions 68 and 70 which terminate in rearward end portions 72 and 74. Stops 73 and 75 are secured, by welding or the like, to the lower ends of pivot frame members 60 and 62, respectively, for engagement with the rearward ends of mounting frame members 40 and 42, respectively, to limit the pivotal movement of pivot frame 56, in a counterclockwise direction, as viewed in FIG. 3. Pin 58 extends through registering openings formed in mounting frame members 40, 42 and pivot frame members 60, 62.

An elongated length adjustable linkage 76 is pivotally connected to the rearward end of pivot frame 56 by means of pin or shaft 77 which extends through the rearward end portions 72 and 74 of pivot frame members 60 and 62, respectively. The rearward end of linkage 76 is pivotally connected by pin 79 to a horizontally extending frame member 80 which is pivotally interconnected to one or more of the doors 26 so that the doors connected thereto are moved in unison.

The numeral 81 refers to a pivot arm or pivot arm assembly which is comprised of a pair of pivot arm members 82 and 84. Pivot arm member 82 includes a substantially vertically disposed upper arm member 86 having an upper end 88 and a lower end 90. Pivot arm member 82 also includes an elongated lower arm member 92 secured to the lower end of upper arm 86 and having a forward end 94 and a rearward end 96. Upper arm member 86 is secured to lower arm member 92 by welding or the like. The upper and lower arm members could also be integrally formed if so desired.

Similarly, pivot arm member 84 includes an upper arm member 98 having an upper end 100 and a lower end 102. The numeral 104 refers to the lower arm member of pivot arm member 84 which has a forward end 106 and a rearward end 108. The lower end of upper arm member 98 is secured to lower arm member 104 intermediate the lengths thereof by welding or the like. Upper arm members 98 and lower arm member 104 could be integrally formed if so desired. End portions 107 and 109 are secured to the rearward ends of pivot arms 82 and 84, respectively.

The numeral 110 designates a power cylinder such as an air cylinder having its forward end 112 pivotally connected to and positioned between the forward ends of the lower arm members 92 and 104 of pivot arm members 82 and 84, respectively, by means of pins 114 and 116, respectively. The rearward end 118 of air cylinder 110 is provided with a circular opening 120 through which the cylinder rod 122 extends. The forward end 112 and rearward end 118 are secured together by means of bolt assemblies 124. The rearward end of the cylinder rod 122 is secured to tube 126 by nut 125. Tube 126 is pivotally connected to pivot frame members 60 and 62 by means of pins 127 and 129, which extend from the opposite ends of tube 126, extending through openings 131 and 133 formed in pivot frame members 60 and 62, respectively. As best seen in FIG. 2, the lower ends of end portions 107 and 109 are provided with arcuate recessed areas or notches 128 and 130 formed therein, respectively. Cam followers 135 and 137 are mounted on end portions 107 and 109, respectively, as seen in FIG. 2. The upper forward ends of the pivot frame members 60 and 62 are provided with arcuate cam surfaces 132 and 134, respectively (FIG. 2). The lower forward ends of pivot frame members 60 and 62 are provided with arcuate recesses 141 and 143 (FIG. 2) formed therein, respectively.

The upper end of upper arm member 86 and the upper end of upper arm member 98 are pivotally connected to and are received between the mounting frame members 40 and 42 by means of pin 139. As seen in the drawings, the pivotal connection (135) between the upper ends of the upper arm members 86 and 98 and mounting frame members 40 and 42 is positioned above and rearwardly of the pivotal connection (114 and 116) between the forward end of air cylinder 110 and the lower arm members 92 and 104 of pivot arm members 82 and 84. Further, it is important to note that the pivotal connection (135) between the upper arm members 86 and 98 of pivot arm members 82 and 84 with respect to the mounting frame members 40 and 42 is located above and forwardly of the pivotal connection (127 and 129) between the cylinder rod 122 of the air cylinder 110 and the pivot frame members 60 and 62. It is also important to note that the pivot connection (127 and 129) between the cylinder rod 122 of the air cylinder 110 and the pivot frame members 60 and 62 is located below and forwardly of the pivotal connection (58) between the pivot frame members 60 and 62 and the mounting frame members 40 and 42 when the air cylinder is in its retracted position of FIG. 3. It is also important to note that the pivotal connection (77) between the forward end of the linkage 76 and the pivot frame members 60 and 62 is generally in alignment and positioned between, and slightly below, the pivotal connection (58) of the pivot frame 56 to the mounting frame 30 and the pivotal connection 140 when the cylinder is retracted. If air cylinder 110 should fail or if the supply of air supplied thereto is disconnected, the weight of the material within the hopper cannot force doors 26 open since the force will be supplied to the pin 58 and stop 73 due to the toggle effect.

Figure 3:
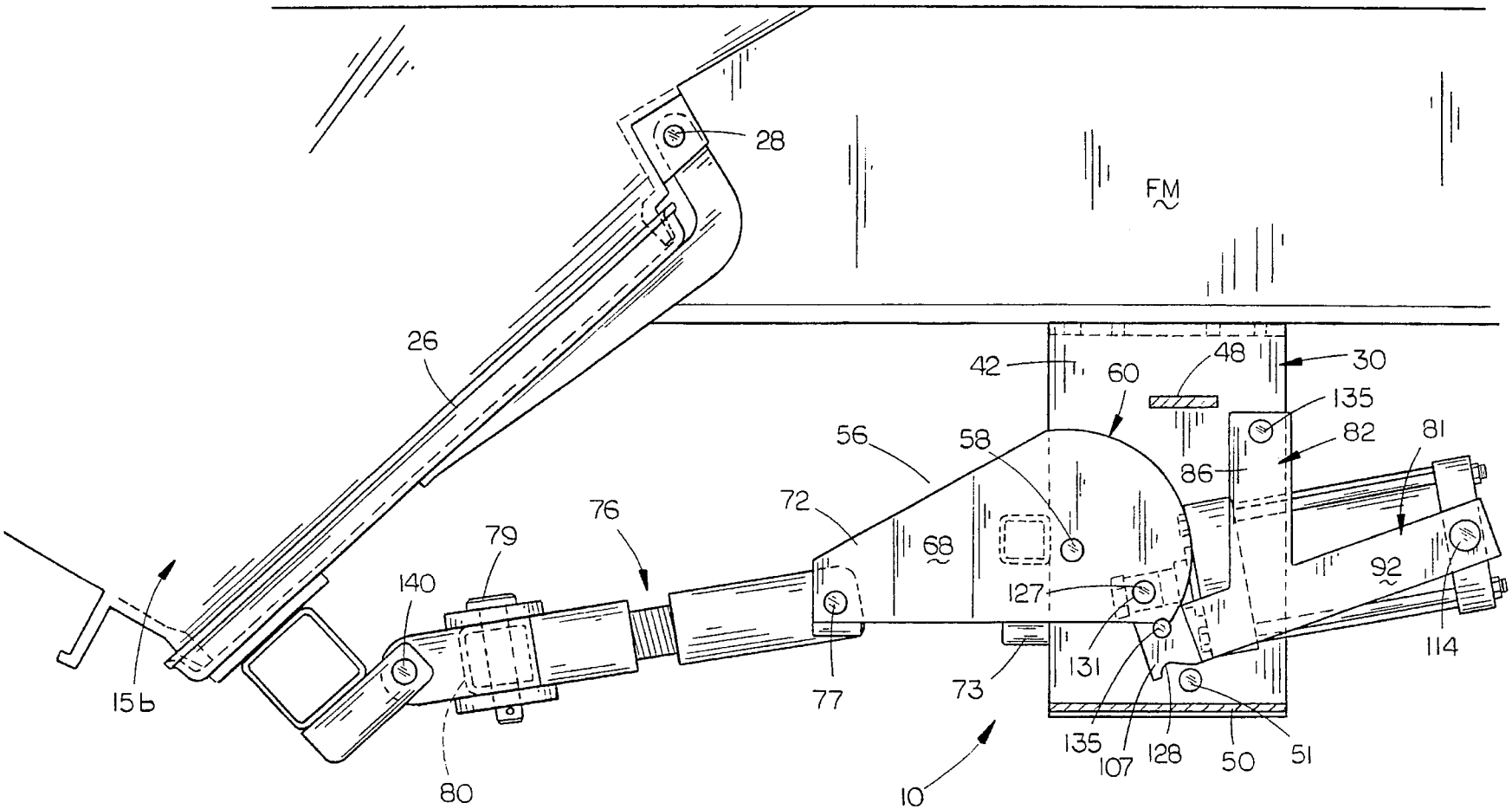
FIG. 3 is a side elevational view of the device of this invention mounted on the hopper car with the discharge doors in a closed position.
Figure 4:
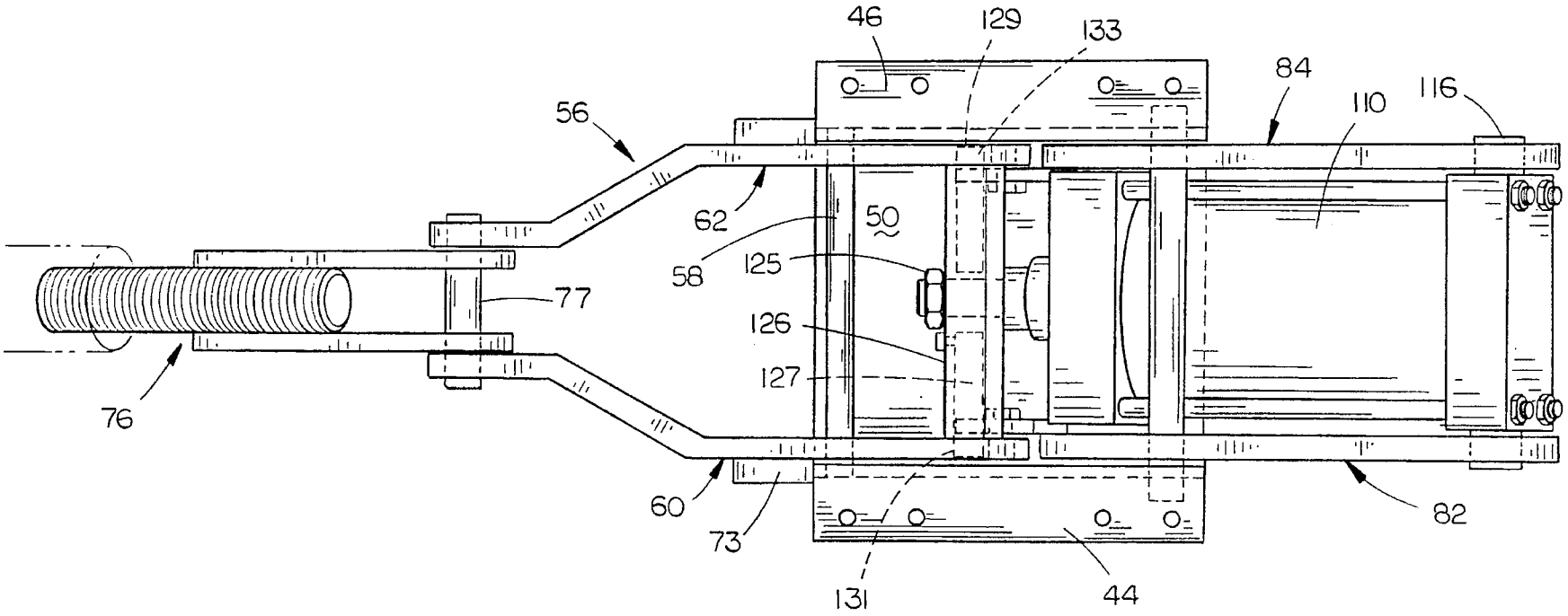
FIG. 4 is a top elevational view of the device of this invention.

In operation, assuming that the door or doors 26 are in their closed position, as illustrated in FIG. 3, it can be seen that the cylinder rod 122 is in its retracted position so that it will not be exposed to dust, dirt, abrasive materials, etc., during the transport operation. When the hydraulic cylinder 110 is in the retracted position, the arcuate recesses 141 and 143 on pivot frames 60 and 62, respectively, will be in engagement with the cam followers 135 and 137 to prevent the clockwise pivotal movement of pivot frame members 60 and 62. The stops 73 and 75 are in engagement with the rearward end of mounting frame members 40 and 42 to limit the counterclockwise pivotal movement of the pivot frame members 60 and 62 with respect to mounting frame 30. As seen in FIG. 3, as previously described, should air pressure to the hydraulic cylinder 110 be lost or in the event of failure of the cylinder 110, the door 26 cannot be pivoted open by the weight of the material within the hopper car due to the alignment of the longitudinal axis of the linkage means 76, the pivot points 77 and 58 and the locking action of the cam followers 135 and 137 in the recesses 141 and 143, respectively, on pivot frame members 60 and 62, respectively.

Figure 5:
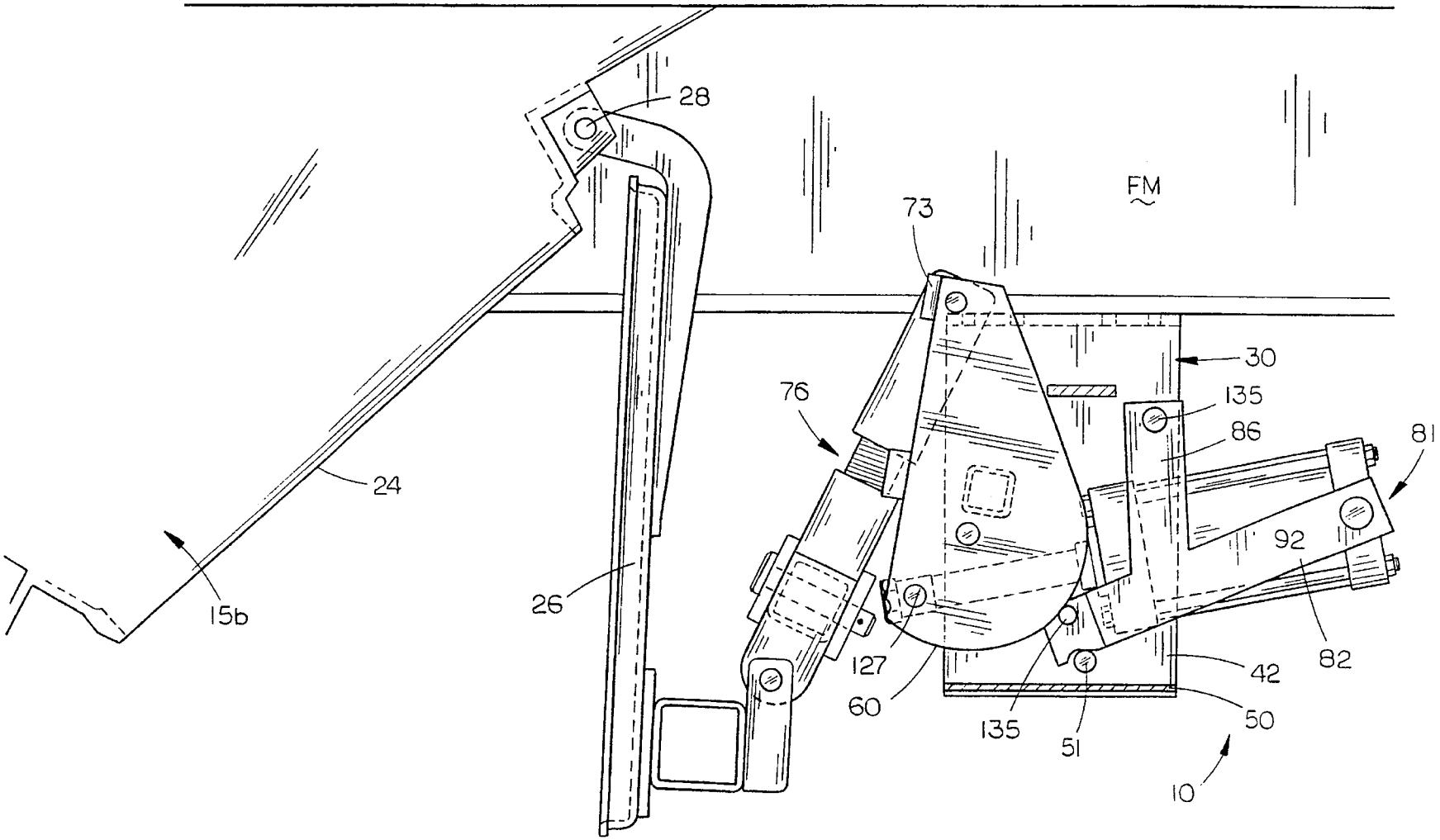
FIG. 5 is a side elevational view of the device of this invention illustrating the discharge doors to which it is connected in an open position.

When it is desired to open the door or doors 26, the hydraulic cylinder 110 is activated so that the cylinder rod is extended therefrom from the position of FIG. 3 to the position of FIG. 5. Extension of the cylinder rod 122 from the position of FIG. 3 to the position of FIG. 5 causes the pivot arm assembly 82 to slightly pivot about pin 135 so that the arcuate recesses 128 and 130 are received by the pin 51. Extension of the cylinder rod 23 causes the pivot frame assembly 56 to pivot from the position of FIG. 3 to the position of FIG. 5 which causes the length adjustable linkage 76 to move upwardly and forwardly so that the door or doors 26 are pivotally moved to the open position illustrated in FIG. 5. As the pivot frame assembly 56 pivots from the position of FIG. 3 to the position of FIG. 5, the cam surfaces 132 and 134 on the pivot frames 60 and 62, respectively, roll upon or engage the cam followers 135 and 137, respectively.

When the material in the hopper car has been discharged through the opening 24, the hydraulic cylinder is again retracted so that the various components pivot from the position of FIG. 5 to the position of FIG. 3 to once again close the door or doors 26.

Thus it can be seen that a novel apparatus has been provided for opening and closing the discharge doors of a railroad hopper car which not only ensures that the cylinder rod of the air cylinder will be in the retracted position during normal transportation to prevent the cylinder rod from being exposed to foreign materials which could cause failure of the seals on the cylinder, but also which ensures that the door or doors 26 will be positively maintained in the closed position during the transport operation. It can also be seen that the apparatus of this invention can be easily retrofitted onto existing hopper cars without extensive modification thereof.

Thus it can be seen that the invention accomplishes at least all of its stated objectives.

I claim:

1. In combination with a railroad hopper car having rearward and forward ends and including at least one hopper body bottom having at least one forwardly presented discharge opening formed therein, a door selectively closing said discharge opening, said door having an upper and lower end, said door being pivotally secured at its upper end to the said hopper car, comprising:

at least one mounting frame operatively secured to said hopper body forwardly of and below the pivotal connection of said door to said hopper body;

said frame extending downwardly from said hopper body and having an upper end, a lower end, a rearward end and a forward end;

a vertically disposed pivot frame assembly having an upper end, a lower end, a rearward end and a forward end;

said pivot frame assembly comprising first and second, horizontally spaced-apart pivot frames;

each of said pivot frames being pivotally secured, about a horizontal axis, intermediate its upper and lower ends and intermediate its rearward and forward ends, to said mounting frame intermediate the upper and lower ends thereof;

a linkage pivotally connecting the rearward end of said pivot frame to said door;

a pivot arm assembly including first and second pivot arms;

each of said first and second pivot arms comprising a vertically disposed upper arm member having upper and lower ends and an elongated lower arm member having rearward and forward ends;

said lower end of each of said upper arm members being secured to the associated lower arm member intermediate the rearward and forward ends thereof;

the upper end of each of said upper arm members being pivotally secured to said mounting frame above and forwardly of the pivotal connection between said pivot frames and said mounting frame;

an elongated power cylinder including a cylinder body having rearward and forward ends and a cylinder rod movably extending rearwardly therefrom and being movable between retracted and extended positions;

said forward end of said cylinder body being operatively pivotally connected, about a horizontal axis, to said forward end of said lower arm members of said pivot arms;

said cylinder rod being pivotally connected, about a horizontal axis, to said pivot frames below and forwardly of the pivot connection between said pivot frames and said mounting frame;

the extension of said cylinder rod from said cylinder body causing said pivot frames to pivot with respect to said mounting frame thereby causing said linkage to move the door secured thereto from a closed position to an open position;

the retraction of said cylinder rod into said cylinder body causing said pivot frames to pivot with respect to said mounting frame thereby causing said linkage to move the door secured thereto from an open position to a closed position.

2. The combination of claim 1 wherein said pivot frames have a longitudinal axis, and said linkage has a longitudinal axis and wherein said pivot frames and said linkage are substantially aligned in a parallel manner when said cylinder rod is in its retracted position.

3. The combination of claim I wherein said pivot frames have a bottom end, said forward end of each of said pivot frames being arcuate, and wherein said pivot frames have an arcuate recess formed therein adjacent the junction of said bottom end and said forward end, said rearward end of said lower arm member of each of said pivot arms having a horizontally disposed pin means associated therewith which is received by said arcuate recess in said pivot frames when said cylinder rod is in its retracted position.

4. The combination of claim 3 wherein said pivot frame assembly has a stop means provided thereon which is positioned below the rearward end of said lower arm members of said pivot arms to limit the downward movement of said lower arm members.

5. The combination of claim 1 wherein a frame member interconnects a plurality of said doors and wherein the rearward end of said linkage is pivotally connected to said frame member so that the said plurality of doors are simultaneously pivotally moved between their open and closed positions.

6. The combination of claim 1 wherein said power cylinder is an air cylinder.

7. The combination of claim 1 wherein said linkage is length adjustable.

8. The combination of claim 1 wherein said mounting frame comprises first and second mounting frame members which are horizontally spaced-apart with respect to one another.

9. The combination of claim 1 wherein said power cylinder is positioned between said first and second pivot arms.

10. The combination of claim I wherein said first and second pivot frames have an interconnection means extending therebetween and wherein said cylinder rod is pivotally connected to said interconnection means.

11. The combination of claim 8 wherein first and second pivot arms are pivotally connected to said first and second mounting frame members, respectively.

12. The combination of claim 11 wherein said power cylinder is positioned between said first and second pivot arms and wherein said first and second pivot arms are positioned between said first and second mounting frame members.

13. In combination with a railroad hopper car having rearward and forward ends and including at least one hopper body bottom having at least one forwardly presented discharge opening formed therein, a door selectively closing said discharge opening, said door having an upper and lower end, said door being pivotally secured at its upper end to the said hopper car, comprising:

at least one mounting frame operatively secured to said hopper body forwardly of said door;

said frame extending downwardly from said hopper body and having an upper end, a lower end, a rearward end and a forward end;

a vertically disposed pivot frame assembly having an upper end, a lower end, a rearward end and a forward end;

said pivot frame assembly being pivotally secured, about a horizontal axis, to said mounting frame intermediate the upper and lower ends thereof;

a linkage pivotally connecting the rearward end of said pivot frame assembly to said door;

a pivot arm assembly having an upper end, a lower end, a forward end and a rearward end;

the upper end of said pivot arm assembly being pivotally secured to said mounting frame above and forwardly of the pivotal connection between said pivot frame assembly and said mounting frame;

an elongated power cylinder including a cylinder body having rearward and forward ends and a cylinder rod movably extending rearwardly therefrom and being movable between retracted and extended positions;

said forward end of said cylinder body being operatively pivotally connected, about a horizontal axis, to said forward end of said pivot arm assembly;

said cylinder rod being pivotally connected, about a horizontal axis, to said pivot frame assembly below and forwardly of the pivot connection between said pivot frame assembly and said mounting frame;

the extension of said cylinder rod from said cylinder body causing said pivot frame assembly to pivot with respect to said mounting frame thereby causing said linkage to move the door secured thereto from a closed position to an open position;

the retraction of said cylinder rod into said cylinder body causing said pivot frames to pivot with respect to said mounting frame thereby causing said linkage to move the door secured thereto from an open position to a closed position.

14. The combination of claim 13 wherein said pivot frame assembly comprises first and second, horizontally spaced-apart pivot frames;

each of said pivot frames being pivotally secured, about a horizontal axis, intermediate its upper and lower ends and intermediate its rearward and forward ends, to said mounting frame intermediate the upper and lower ends thereof;

said pivot arm assembly including first and second pivot arms;

each of said first and second pivot arms comprising a vertically disposed upper arm member having upper and lower ends and an elongated lower arm member having rearward and forward ends;

said lower end of each of said upper arm members being secured to the associated lower arm member intermediate the rearward and forward ends thereof;

the upper end of each of said upper arm members being pivotally secured to said mounting frame above and forwardly of the pivotal connection between said pivot frames and said mounting frame.

15. The combination of claim 14 wherein said power cylinder has a longitudinal axis, said pivot frames having a longitudinal axis, and said linkage having a longitudinal axis and wherein the longitudinal axes of said power cylinder, said pivot frames and said linkage are substantially aligned in a parallel manner when said cylinder rod is in its retracted position.

16. The combination of claim 14 wherein said pivot frames have a bottom end, said forward end of each of said pivot frames being arcuate, and wherein said pivot frames have an arcuate recess formed therein adjacent the junction of said bottom end and said forward end, said rearward end of said lower arm member of each of said pivot arms having a horizontally disposed pin means associated therewith which is received by said arcuate recess in said pivot frames when said cylinder rod is in its retracted position.

17. The combination of claim 16 wherein said pivot frame assembly has a stop means provided thereon which is positioned below the rearward end of said lower arm members of said pivot arms to limit the downward movement of said lower arm members.

18. The combination of claim 14 wherein a frame member interconnects a plurality of said doors and wherein the rearward end of said linkage is pivotally connected to said frame member so that the said plurality of doors are simultaneously pivotally moved between their open and closed positions.

19. The combination of claim 14 wherein said power cylinder is an air cylinder.

20. The combination of claim 14 wherein said linkage is length adjustable.

21. The combination of claim 14 wherein said mounting frame comprises first and second mounting frame members which are horizontally spaced-apart with respect to one another.

22. The combination of claim 14 wherein said power cylinder is positioned between said first and second pivot arms.

23. The combination of claim 14 wherein said first and second pivot frames have an interconnection means extending therebetween and wherein said cylinder rod is pivotally connected to said interconnection means.

24. The combination of claim 21 wherein first and second pivot arms are pivotally connected to said first and second mounting frame members, respectively.

25. The combination of claim 24 wherein said power cylinder is positioned between said first and second pivot arms and wherein said first and second pivot arms are positioned between said first and second mounting frame members.

* * * * *